United States Patent [19]

Bennett

[11] Patent Number: 5,071,400

[45] Date of Patent: Dec. 10, 1991

[54] PACKAGE WITH A HANGER AND A METHOD FOR MAKING SUCH A PACKAGE

[75] Inventor: Ronald Bennett, Bay Shore, N.Y.

[73] Assignee: Ultra Creative Corp., Brooklyn, N.Y.

[21] Appl. No.: 608,031

[22] Filed: Oct. 31, 1990

Related U.S. Application Data

[60] Continuation of Ser. No. 313,586, Feb. 21, 1989, abandoned, Division of Ser. No. 214,238, Jul. 1, 1988, abandoned.

[51] Int. Cl.[5] ..... B31B 1/86

[52] U.S. Cl. ..... 493/223; 493/226

[58] Field of Search ..... 493/194–197, 493/209, 226, 223, 225, 345, 348, 350, 926, 200, 201–203, 224

[56] References Cited

U.S. PATENT DOCUMENTS

| | | | |
|---|---|---|---|
| 3,693,867 | 9/1972 | Schwarzkopf | 383/27 |
| 4,018,134 | 4/1977 | Linsinger . | |
| 4,208,045 | 6/1980 | Rowe et al. | 269/234 |
| 4,297,927 | 11/1981 | Kuroda . | |
| 4,347,930 | 9/1982 | Herrin | 206/45.34 |
| 4,583,719 | 4/1986 | Klingel . | |
| 4,590,610 | 5/1986 | Rhyne | 206/45.33 |
| 4,704,100 | 11/1987 | Kaufman | 493/224 |
| 4,706,949 | 11/1987 | Dossey et al. | 269/283 |
| 4,819,922 | 4/1989 | Boike | 269/45 |

FOREIGN PATENT DOCUMENTS

| | | |
|---|---|---|
| 183298 | 6/1985 | European Pat. Off. . |
| 1314169 | 7/1969 | United Kingdom . |

*Primary Examiner*—James G. Smith
*Assistant Examiner*—Jack Lavinder
*Attorney, Agent, or Firm*—Alan K. Roberts

[57] ABSTRACT

A package is provided which is formed of a plastic film such as polyethylene or polypropylene. The package is formed to define an internal chamber to accommodate an article to be packed. A slit is provided in the wall and a hanger is provided a part of which extends through the slit. This part is provided with projections which lock the hanger against retraction into the internal chamber. The projections are rounded and/or wedge shaped to facilitate penetration of the hanger through the slit. According to the method by which such a package is formed the projections are shaped to penetrate through the slightly smaller slit without exceeding the elastic limit of the material from which the package is formed. Thereby the material can resume its original shape after the projections have been forced through the slit.

19 Claims, 2 Drawing Sheets

PACKAGE WITH A HANGER AND A METHOD FOR MAKING SUCH A PACKAGE

This is a continuation of copending application Ser. No. 07/313,586 filed on Feb. 21, 1989 which is a divisional of Ser. No. 214,238 filed July 1, 1988 now abandoned.

FIELD OF INVENTION

This invention relates to packages for the accommodation of articles of commerce and the like and more particularly to packages which are provided with hangers for purposes of storage and display. The invention also relates to methods of manufacturing packages of the aforenoted type and particularly to methods of inserting hangers into plastic packages made of a pliable film.

BACKGROUND

U.S. Pat. No. 4,590,610 makes reference to the display of packaged articles by the hanging of packaged articles from a peg or rod. This patent describes the fact that some of these packages include a transparent or translucent plastic bag which is provided with a hole through which the aforementioned or rod may extend. Reference is also made to the fact that potential consumers are inclined to remove such packages from their associated pegs and to the fact that replacement of the packages on such pegs is a somewhat difficult matter.

U.S. Pat. No. 4,590,610 discloses, for purposes of avoiding difficulty such as noted above, display packages in which a plastic bag is provided with a plastic hanger. The plastic hanger is disposed within a pocket formed at the top of the bag with the hook portion of the hanger extending through a hole in the top peripheral edge of the bag. The bag has layers thereof bonded together below the hanger to entrap the hanger within the bag. This patent discloses a method of forming a hangable package by positioning the hanger within the bag and bonding the layers of the bag together while the top edge of the hanger arms is positioned against the top peripheral edge of the bag.

It will be noted that certain difficulties may occur with respect to the type of construction envisaged in U.S. Pat. No. 4,590,610. First of all the positioning of the hanger depends upon the seam which is developed beneath the hanger since the hook portion of the hanger itself has no provision for locking the same against the displacement. It will also be noted that a hanger of such a construction is readily susceptible of lateral movement since the slit which accommodates the insertion of the hanger must be wide enough to accommodate the hook portion thereof while the neck which connects the hook to the internal base portion of the hanger is substantially narrower than the slit thereby permitting undesirable lateral movement of the bag relative to the hanger.

Other patents which make reference to the provision of a hanger in a polyethylene bag or the like include the Brewill U.S. Pat. No. 4,385,722, the Herrin U.S. Pat. No. 4,347,930 and the Strongwater U.S. Pat. No. 4,349,102. In the Brewill construction, the hanger tends to fall into the bag when it is not supporting the associated package and, in instances where an adhesive is applied to the bag material, this involves an additional undesirable step. In the Strongwater Patent, the structure is such that a hanger is sandwiched between a pair of shelves forming the associated package and special assembly techniques must be employed to flex and position the hanger. Other U.S. patents relating generally to the subject matter of the instant invention include U.S. Pat. Nos. 3,098,561; 3,429,498; 3,500,995; 3,549,085; 3,651,929; 3,693,867; 3,695,418; 3,782,622; and 4,084,689.

SUMMARY OF INVENTION

It is an object of the invention to provide an improved package provided with improved means for suspending the same for purposes of display.

It is another object of the invention to provide an improved package made of plastic film or the like and provided with an associated hanger to provide for the display of the same and for articles accommodated therein.

Yet another object of the invention is to provide an improved arrangement for associating hangers with plastic film packages wherein the relationship between the hanger and the package is maintained in fixed and unvarying relationship.

It is a further object of the invention to provide an improved method for installing hangers in packages made of pliable plastic film or the like.

In achieving the above and other objects of the invention there is provided a package comprising a wall of plastic film defining an internal chamber adapted to accommodate an article to be packed. When reference is made to an article herein, such article for example be in comminuted form or powered or may be in the form of a garment, toy, piece of hardware or the like. The aforesaid wall is provided with a slit and a hanger includes a first part which is installed in the chamber and a second part which is mounted on the first part and extends through the above mentioned slit externally of the chamber to constitute a structure by which the wall or package can be supported in hanging or suspended relationship. The second part includes an arrangement for locking the hanger against retraction into the chamber. In a preferred embodiment of the invention, the wall has the shape of a flat bag and the hanger is also of generally flat shape. Preferably, the hanger is fabricated of plastic and the wall may preferably be polyethylene.

According to a feature of the invention, the first part mentioned above and the arrangement for locking the hanger against retraction are spaced from one another and the hanger includes a throat portion interconnecting the first part and the aforesaid arraangement. The throat portion and slit have substantially equal widths, and the first part and arrangement have widths which exceed the widths of the slit.

According to another feature of the invention, the plastic film from which the package is fabricated has an elastic limit which permits the aforementioned arrangement to be forced through the slit without substantial permanent deformation of the wall adjacent the slit. According to another feature of the invention, the structure preferably includes a hook.

As will be seen in detail hereinbelow the above-mentioned arrangement includes wings or projections extending in opposite directions from above-mentioned second part and these wings or projections are of a shape to facilitate penetration of the second part through the above-mentioned slit. The projections in extending in opposite directions from the throat portion provide a width which exceeds that of the slit.

More particularly, according to a further feature of the invention one of the above-mentioned projections includes a rounded portion facilitating penetration of the second part through the slit. one of the projections may also be a wedge shaped portion thus also operating to facilitate penetration of the second part through the slit.

The size of the film may contribute to a feature of the invention by reason of the elastic limit characteristic thereof. Preferably the film is polyethlene or polypropylene having a thickness in the order of magnitude of about 0.00125 to 0.003 of an inch. The rounded portion mentioned above may preferably have a radius of about 0.030 inches.

As will also be seen in the detailed description which follows hereinbelow, the bag may preferably include facing wall portions and a flap is provided on one of these wall portions with the first part of the hanger being positioned between the aforesaid flap and said one wall portion. The flap and the associated wall portion are preferably hingedly connected along a fold line and the flap and this one wall portion may preferably be further connected along a seam spaced from the fold line. In this event, the above-mentioned first part of the hanger will be located between the seam and fold line.

Other features of the invention comprise the provision of an arrangement for detachably fastening of the flap to the other of the wall portions and the film's being of a meterial having an elastic limit capable of accommodating the penetration of the above-mentioned projections through the slit without causing permanent deformation of the film.

As has been mentioned hereinabove, the method of the invention consitutes a significant aspect thereof. According to the method of the invention, there is comprised the steps of forming a bag of a plastic film having an elastic limit, cutting a silt into the film, and forming a hanger with a hook part adapted for being inserted through this slit. The hanger includes a hook part, a base part, and a throat part connecting the hook part to the base part and having a width corresponding to that of the slit. The method further comprises forming at least one projection on the hook part to exceed the width of the slit and the step of forcing the hook part and projection through slit without exceeding the elastic limit of the film to lock the hanger to the bag.

Features of the method of the invention include forming two of the aforesaid projections on the hook part with at least one of these projections being formed with a rounded shape to facilitate penetration of the hook part through the slit. Alternatively or in conjuction with the aforesaid step, the method of the invention may include forming projections at least one of which is wedge shaped.

The method of the invention may comprise forming the plastic into first and second facing walls and forming a flap on the first wall along a fold line and then cutting the slit along the fold line. The walls may be sealed in accordance with the method of the invention into successive bags, each of which is formed with a slit through which is inserted a hook part of a respective hanger. In further accordance with the method of the invention the width of the slit may be exceeded by an amount by the order of magnitude of six sixteenths of an inch. The size of the film in terms of its thickness has been mentioned hereinabove. The slit, as will be seen, may be cut by a reciprocating cutting instrument such as a razor.

Other objects, features, and advantages of the invention will be found in the detailed description which follows hereinbelow as illustrated in the accompanying drawing.

DETAILED DESCRIPTION

Figure 1:
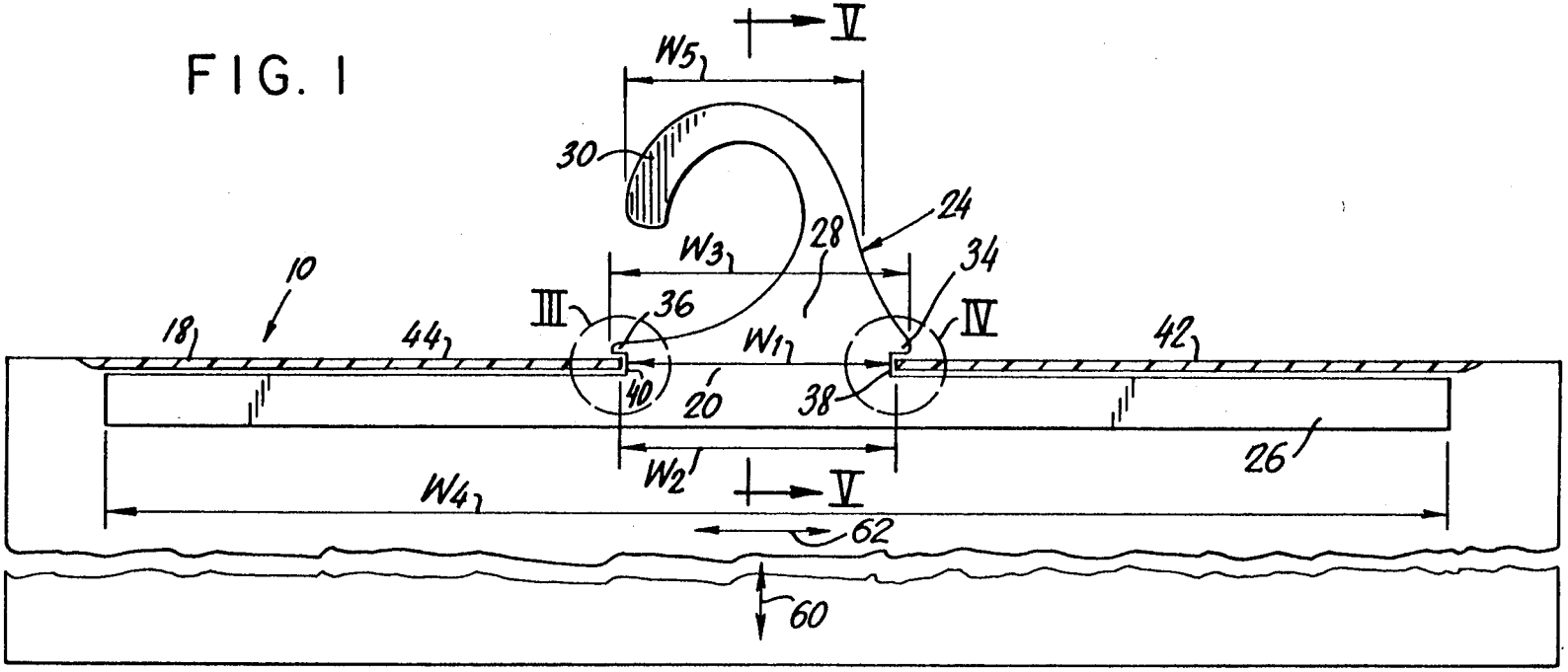
FIG. 1 is a partially broken away veiw of a package provided in accordance with the invention and provided with a hanger in accordance with features of the invention, the veiw being partially in section.
Figure 5:
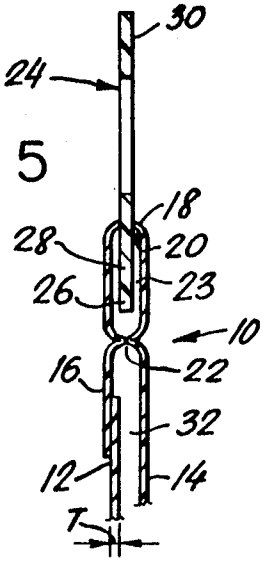
FIG. 5 is a fragmentary cross-sectional veiw taken through the structure illustrated in FIG. 1 along line V—V.
Figure 2:
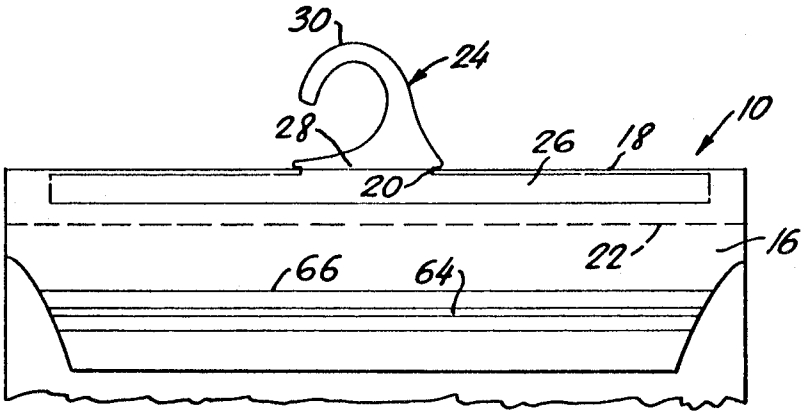
FIG. 2 is a fragementary veiw of the top portion of a bag such as illustrated in FIG. 1 illustrating the flap in greater detail.

In FIGS. 1, 2 and 5 appears a bag 10 fabricated of a pliable film. The film may be of various types of material, but is preferably of polyethylene or polypropylene having a thickness preferably in the order of magnitude of 0.00125 to 0.003 inches. The material of which the bag is fabricated and its thickness along with certain other factors such as temperature will determine the elastic characteristics and limit of the material from which the bag is made. The elastic limit is an important consideration of the present invention, but a plastic film of thicknesses indicated will be adequate for the other dimensions to be indicated hereinbelow to enable the performance of the various features of the invention as will become more readily understood hereinbelow.

The bag 10 includes a front wall or wall portion 12 and a rear wall or wall portion 14. The wall portions 12 and 14, may for example be connected at their lower peripheral edges along a fold line if the bag is a top loading bag. The walls 12 and 14 may be separated along their lower peripheral edges to permit of bottom loading whereafter the bottom peripheral edges will be thermally sealed together. Whether the bag is bottom loading or top loading does not affect the major features of the invention.

In addition to the aforesaid walls or wall portions 12 and 14, the bag 10 furthermore includes a flap or flap portion 16. The flap portion may be described in copending application, Ser. No. 163,297 filed March 1, 1988 . The contents of that copending application are embodied herein as though disclosed fully in this text.

It will be seen that the flap portion 16 is joined to the rear wall portion 14 along a fold line indicated at 18. This fold line is cut along a restricted centrally located portion indicated at 20 to form a slit through which penetrates a portion of hanger to be discribed hereinbelow.

The rear wall portion and the flap portion 16 may be weled together as indicated at 22. The purpose of the weld or seam 22 is to form a sub-chamber 23 with the fold line 18 which entraps a portion of the hanger to be described. More specifically, the invention employs a hanger 24 which includes a base part 26, a throat part 28, and a hook part 30. The base part 26 is an elongated rectilinearly extending flat piece of plastic with which the other two parts are monolithic. Preferably the hanger 24 is fabricated of plastic such as polystyrene. It may have a thickness, for example, in the range of from 0.150 to 0.350 inches. This range may be exceeded without departing from the scope of the invention and as long as the hanger has sufficient strength to be shaped retentive and to support the load of the article or articles which may be accommodated within the internal chamber 32 of the bag.

The throat portion 28 of the hanger 24 is provided with two projections or wings 34 and 36. The projection or wing 34 defines with the base part 26 a square notch which is indicated at 38 (see also FIG. 4) The projection or wing 36 defines with the base part 26 a square notch which is indicated at 40 (see also FIG. 3). Accommodated in these notches is the film along the fold line 18, this film being indicated at 42 and 44.

Figure 3:
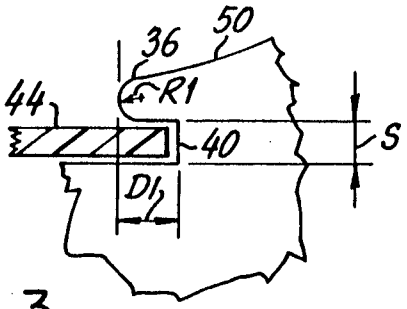
FIG. 3 is an enlarged veiw of the portion encircled in FIG. 1 at III.

As is best seen in FIG. 3, the projection or wing 36 has a rounded contour the radius of which is indicated at R1. This radius may preferably be in the order of magnitude of about 0.030 inches, although this dimension can be widely varied while remaining within the scope of the invention. Notch 40 will preferably have a depth S which may be, for example, in the order of magnitude of 0.100 inches. The projection 36 may have an upper sloped surface indicated at 50. This sloped surface will constitute with the rest of the projection, a wedge shaped portion which along with the shape of the other projection illustration in FIG. 4 will readily accommodate the penetration of the throat and hook shaped portions 28 and 30 without any tearing of the plastic film of the bag.

Figure 4:
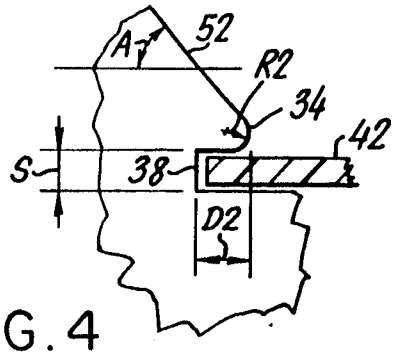
FIG. 4 is an enlarged veiw of a fragmentary portion of the structure illustrated in FIG. 1 encircled at IV.

FIG. 4 illustrates the notch 38 which also has a dimension S in the order of magnitude of 0.100 inches. Notch 38 accommodates the thickness of film 42 and projection 34 has a radius R2 generally in the order of magnitude of about 0.030 inches.

Sloped edge or upper surface 52 forms an angle A in the order of magnitude of 75–85 degrees with base part 26 of the hanger. Projection 34 thus also constitutes a wedge sloped portion which together with projection 36 (or by itself) facilitates penetration of the hanger through slit 20 until base part 26 comes up against fold 18.

Width W1 is the width of the hanger throat between notches 38 and 40. Slit 20 has a width which is generally indicated at W2. The projections 34 and 36 are such as to extend laterally beyond this width by an amount which, for example, may be in the order of magnitude of 3/16ths of an inch at (see sides D1 and D2) dimensions. Thus, width W2 (which is the width of the slit 20) is less than width W3 of the throat 28 across the projections 34 and 36. Width W3 will preferably exceed the width W2 by an amount which is approximately 6/16ths of an inch (twice 3/16ths of an inch). The width W5 of the hook shaped portion 30 is a dimension which is generally substantially less than the width W2. The purpose of this is to permit the hook shaped portion 30 to be inserted readily without interference through the slit 20 to extend outwardly of the internal chamber 32 of the bag.

The dimension W4 constitutes the length of the base part 26. It is a sufficiently long as to give some stability to the combination of the bag and the hanger and to retain the shape of the upper portion of the bag. The lateral extent of the projections 34 and 36 are, respectively shown in FIGS. 3 and 4 at D1 and D2. As indicated generally hereinabove, this lateral extension of the projections or wings 34 and 36 along with the elastic quality of the material from which the bag is made (including the elastic limit thereof) are all of a magnitude such that the hook part 30 and throat 28 may be displaced to penetrate through the slit 20.

The projections 34 and 36 do not stretch the bag material beyond its elastic limit. Hence, the bag material snaps into notches 38 and 40 and tightly grasps the hanger.

As a consequence, two very important objects of the invention are achieved. Firstly, the hanger is held in firm, positionally fixed relationship relative to the top of the bag considered in the directions which shown by arrow 60 (see FIG. 1). Secondly, the hanger is prevented from being dislodged in either lateral sense as indicated by arrow 62 in FIG. 1.

FIG. 2 shows an arrangement disclosed in the above mentioned copending application for fastening the flap of the bag in closed relation to the main body of the bag. This arrangement is indicated generally in the form of a strip 64 of adhesive on a substrate strip 66 all as explained in the aforesaid copending application.

Figure 6:
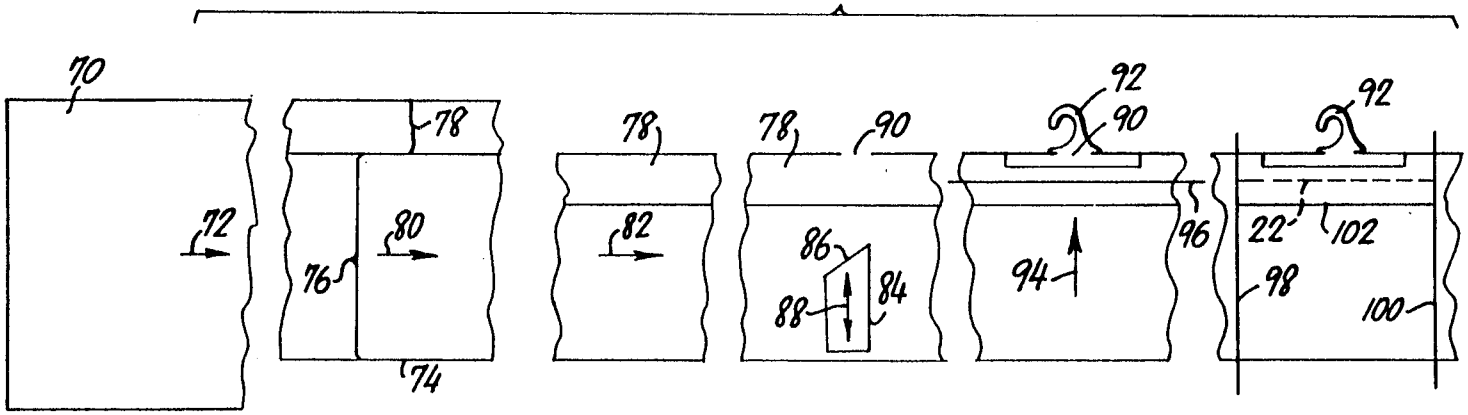
FIG. 6 is a diagrammatic veiw illustrating the various steps of a method provided in accordance with the invention.

The method of the invention is indicated generally in FIG. 6. Therein appears a roll of polyethylene or polypropylene film indicated at 70, the film being moved in the direction indicated by arrow 72. As explained in the aforesaid copending application, the film may be folded along a fold line 74 to provide an overlapping expanse indicated at 76 thereby forming the front and rear walls of the bags being processed and providing an excess indicated at 78.

The next step is constituted by the folding down of the section 78 to form a flap. In the second and third, steps the bag is proceeding in the directions indicated by arrows 80 and 82.

In the next step is employed a reciprocating cutting tool 84 having a sharp razor edge indicated at 86. This cutting tool is reciprocable as indicated by arrow 88. The flap 78 is raised by means (not shown) with a slit being formed as indicated at 90.

In the next step, the hanger indicated at 92 is displaced (from a stack of such hangers) in the direction shown by arrow 94 with the throat portion and hook part being displaced through the slit 90 thereby locking the hanger in position in both lateral and vertical senses as described above.

A thermal welding tool is indicated at 96. This tool provides the seam indicated at 22 in FIG. 2. In the next step is indicated the thermal sealing and cutting tools 98 and 100 (one may be sufficient). These tools cut the finished bags sequently from the continuous strips to provide the finished article.

It will thus be noted that, according to the method of the invention, there are included the steps of forming a bag of plastic film having a characteristic elastic limit, cutting a slit into the film, forming a hanger with a hook part for being inserted through this slit and further having a base part and a throat part connecting the hook part to the base part. The throat part has a width corresponding to that of the slit and the method of the invention includes forming projections on the hook part or throat part to exceed the width of the slit. Thereafter the hook part is forced with its projections through the slit without exceeding the elastic limit of the film to lock the hanger to the bag.

The projections formed on the hook or throat part are formed with a rounded and/or wedge shape in order to facilitate penetration of the hook and/or throat part through the slit. The film is formed into first and second facing parts with a flap being formed on the first wall along a fold and with the slit being preferably cut along this fold line.

According to a feature of the invention as should now be apparent from the above an important feature is to enable the hanger to be forced through the slit without any substantial permanent deformation of the wall adjacent the slit so that the bag material can lockingly engage in the square notches formed in the hanger.

There will now obvious to those skilled in the art many modifications and variations of what has been described above. Such modifications and variations will not depart from the scope of the invention if defined by the following claims.

What is claimed is:

1. A method of inserting hangers in plastic bags, said method comprising forming a series of bags in a plastic film having an elastic limit by forming therein front and back faces one of which extends beyond the other to provide an excess, folding the excess to form a fold line and a flap, reciprocating a cutting tool under the flap to cut slits of predetermined length in the fold line at spaced positions, said hangers each being provided with a hook portion, a base portion, and a throat portion connecting the hook and base portions, the hook portions being dimensioned to pass through the slits and the throat portions being dimensioned to be accommodated in the slits, the hangers each further being provided with at least one projection, the slits being dimensioned so that the projections can be forced through the slits without exceeding the elastic limit of the film, inserting the hangers under the thusly folded flaps with the hook portions being inserted through the slits, and entrapping the fold lines for substantially permanent engagement between the base portions and projections by forcing the projections through the slits within the elastic limit of the film.

2. A method as claimed in claim 1 comprising heat sealing the faces together along seams straddling the slits to form separate bags after each hanger is inserted into the associated slit.

3. A method as claimed in claim 2 comprising notching the sides of the flaps to avoid inclusion of the notched portions in the seams.

4. A method as claimed in claim 1 comprising sealing the flap to one of the faces along a seal which is at least generally parallel to the fold line to entrap the base portions between the seal and fold line while maintaining each hanger otherwise independent of the plastic film.

5. A method as claimed in claim 1 comprising forming the hangers with flat parallel faces to facilitate passage of the hangers through said slits.

6. A method as claimed in claim 5 comprising forming at least some of the projections with a wedge shape to facilitate passage thereof through the associated slits.

7. A method as claimed in claim 1 wherein there are two projections on each hanger and the plastic film is polyethylene or polypropylene of a thickness of about 0.00125 to 0.003 inches and the projections on each hanger collectively exceed the associated slits by about six-sixteenths of an inch.

8. A method as claimed in claim 1 wherein the base portions and projections form square notches into which the film is engaged.

9. A method as claimed in claim 1 wherein each projection is formed as one of two oppositely extending projections on each hanger to trap the fold line against the associated base portion.

10. A method as claimed in claim 1 comprising maintaining the hangers independent of the plastic film.

11. A method as claimed in claim 1 comprising forming at least some of the projections with a rounded shape to facilitate passage thereof through the associated slits.

12. A method comprising forming plastic film having an elastic limit into front and back faces adapted to form bags and one of which extends beyond the other to provide an excess, folding the excess to form a fold line and a flap, reciprocating a cutting tool under the flap to cut slits of predetermined length in the fold line at spaced positions, providing hangers with a hook portion, a base portion, and a throat portion connecting the hook and base portions, the hook portions being dimensioned to pass through the slits and the throat portions being dimensioned to be accommodated in the slits, each hanger being provided with at least one projection, the slits and the projections being dimensioned so that the projections can be forced through the slits without exceeding the elastic limit of the film, and inserting the hangers under the flaps with the hook portions being inserted through the slits and with the projections being forced through the slits within the elastic limit of the film such that the fold lines are entrapped between the base portions and the projections for substantially permanent engagement therebetween.

13. A method as claimed in claim 12 comprising heat sealing the faces together along seams straddling the slits to form separate bags after the hangers are inserted into the associated slits.

14. A method as claimed in claim 12 comprising sealing the flap to one of the faces along a seal which is at least generally parallel to the fold line to entrap the base portions between the seal and fold line while maintaining each hanger otherwise independent of the plastic film.

15. A method as claimed in claim 12 comprising forming at least some of the projections with rounded shapes to facilitate passage thereof through the associated slits.

16. A method as claimed in claim 12 comprising forming at least some of the projections with a wedge shape to facilitate passage thereof through the associated slits.

17. A method as claimed in claim 12 wherein square notches are formed between the projections and base portions and the film is engaged in said notches.

18. A method comprising forming a slit of predetermined length in a polyester film having an elastic limit, providing a hanger with a handle portion, base portion and throat portion connecting the handle and base portions and with the base portion being longer than said predetermined length, the throat portion being substantially no longer than said predetermined length and said handle portion being insertable through said slit without deformation of said film, said hanger being provided with at least one projection defining with said base portion a notch within which to receive the film adjacent said slit, and inserting the handle and throat portions and projection through said slit and entrapping the film for substantially permanent engagement between the base portion and projection, the film being displaced over the projection and into the notch within the elastic limit of the film.

19. A method as claimed in claim 18 wherein the film is displaced over the projection in a single continuous operation along with the insertion of the handle and throat portions through the slit to constitute a substantially permanent engagement.

* * * * *